US009402455B2

(12) United States Patent
Osvaldo

(10) Patent No.: US 9,402,455 B2
(45) Date of Patent: Aug. 2, 2016

(54) COSMETIC PRODUCT APPLICATOR AND ASSOCIATED APPLICATOR ASSEMBLY

(71) Applicant: ALBEA SERVICES, Gennevilliers (FR)

(72) Inventor: Uresti Osvaldo, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 354 days.

(21) Appl. No.: 13/942,678

(22) Filed: Jul. 15, 2013

(65) Prior Publication Data

US 2014/0016985 A1 Jan. 16, 2014

(30) Foreign Application Priority Data

Jul. 16, 2012 (FR) ..... 12 56836

(51) Int. Cl.
*A45D 40/26* (2006.01)
*A46B 9/02* (2006.01)

(52) U.S. Cl.
CPC ..... *A45D 40/265* (2013.01)

(58) Field of Classification Search
CPC combination set(s) only.
See application file for complete search history.

(56) References Cited

U.S. PATENT DOCUMENTS 5,931,594 A * 8/1999 Garcia ..... A46B 11/0058 401/119
8,191,559 B2 * 6/2012 Bickford ..... A45D 40/265 132/218
2005/0238404 A1 * 10/2005 Kurashina ..... B41J 3/32 400/109.1
2010/0175708 A1 7/2010 Kim
2012/0199158 A1 8/2012 Bickford

FOREIGN PATENT DOCUMENTS

DE 102010010956 7/2011

* cited by examiner

*Primary Examiner* — David Walczak
(74) *Attorney, Agent, or Firm* — Steven M. Greenberg, Esq.; CRGO Law

(57) ABSTRACT

A cosmetic product applicator includes a brush. The brush includes a core having a longitudinal axis (X), and one or more protrusions projecting from the core. The protrusions in turn include at least one straight first protrusion having a longitudinal axis oriented in a first radial direction of the core, and at least one bent second protrusion. The bent second protrusion includes a base portion extending from the core and has a longitudinal axis oriented in a second radial direction of the core, and an end portion extending from the base portion and has a longitudinal axis parallel to the longitudinal axis of the straight first protrusion.

18 Claims, 5 Drawing Sheets

COSMETIC PRODUCT APPLICATOR AND ASSOCIATED APPLICATOR ASSEMBLY

CROSS-REFERENCE TO RELATED APPLICATION

Figure 1:
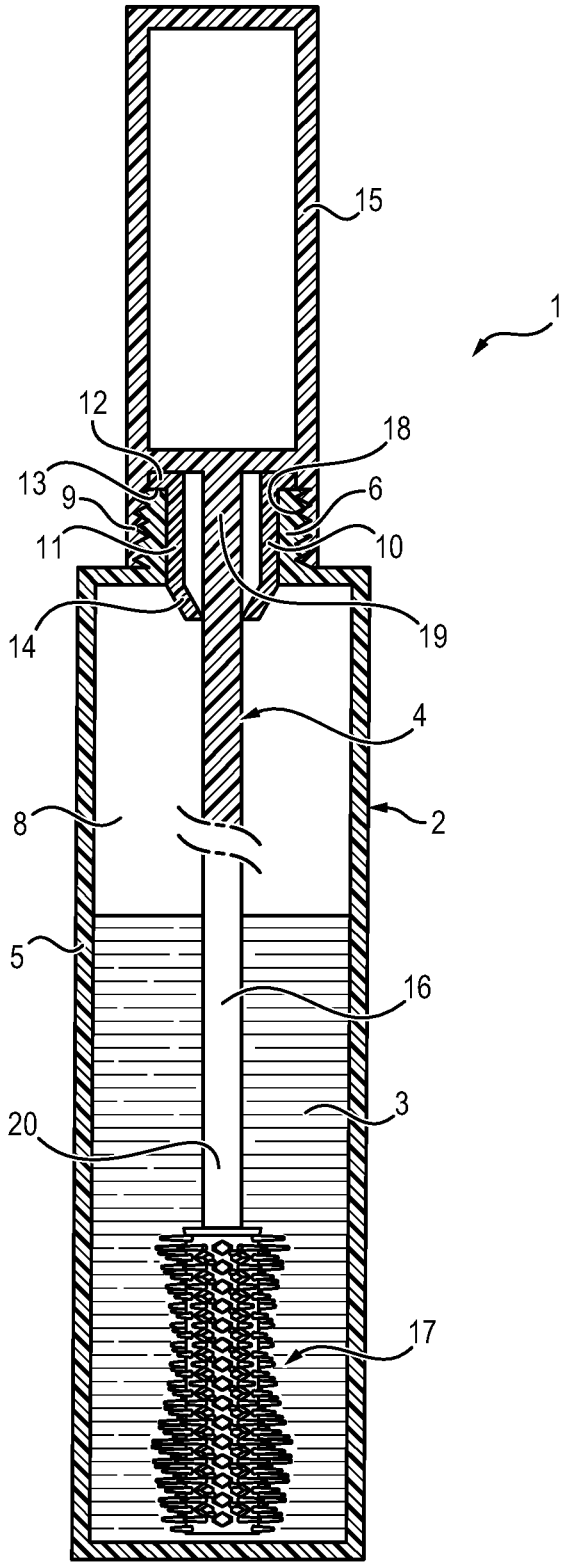

This application claims priority under 35 U.S.C. §119(a) to French Patent Application Serial Number 1256836, filed Jul. 16, 2012, entitled "COSMETIC PRODUCT APPLICATOR AND ASSOCIATED APPLICATOR ASSEMBLY", the entirety of which is incorporated herein by reference.

DESCRIPTION

1. Field of the Invention

The invention relates to a cosmetic product applicator and to an associated applicator assembly.

2. Prior Art

Applicator assemblies for cosmetic products, in particular for cosmetic products to be applied to the eyelashes, such as mascara, comprising a receptacle containing the cosmetic product and an applicator capable of being removably attached to the receptacle, are known.

The receptacle generally comprises a body, the body comprising walls which delimit a container which contains the cosmetic product, and a neck defining an opening through which the cosmetic product can be removed.

The applicator generally comprises a cap which is used as a handle and is capable of being attached to the neck, a rod extending from the cap and a brush attached to a free end of the rod. The brush comprises a core and a plurality of protrusions or bristles extending from the core.

When the cap is attached to the neck, the rod and the brush extend within the container. The brush is immersed in the cosmetic product contained in the container.

To use the applicator, the user detaches the cap from the neck and removes the applicator from the receptacle. The user combs the eyelashes with the brush, and this has the effect of coating the eyelashes with a film of cosmetic product.

In addition, during combing, the user uses the brush to shape the eyelashes, for example by curling them to make them appear longer. As the film of cosmetic product deposited on the eyelashes dries, it holds the eyelashes in the desired shape.

SUMMARY OF THE INVENTION

A problem addressed by the invention is that of proposing an applicator for shaping the eyelashes more easily in order to give them the desired shape when applying the cosmetic product to the eyelashes.

This problem is solved within the context of the present invention by a cosmetic product applicator that includes a brush. The brush in turn includes a core having a longitudinal axis and one or more protrusions projecting from the core. The protrusions include at least one straight first protrusion having a longitudinal axis oriented in a first radial direction of the core, and at least one bent second protrusion. The bent second protrusion includes a base portion extending from the core and having a longitudinal axis oriented in a second radial direction of the core, and an end portion extending from the base portion and having a longitudinal axis parallel to the longitudinal axis of the first protrusion.

The words "radial direction of the core" mean that the longitudinal axis of the protrusion or of the protrusion portion is directed along a radius of the core, that is to say that the longitudinal axis of the protrusion or of the protrusion portion is perpendicular to the longitudinal axis of the core and intersects the longitudinal axis of the core.

In the proposed applicator, the arrangement of the straight first protrusion and of the bent second protrusion enables the brush to better catch the eyelashes during application, and as a result makes it possible to position the eyelashes using the brush, to give the eyelashes the desired shape.

The proposed applicator may further have the following features:

- the protrusions include at least one bent third protrusion comprising a base portion extending from the core and having a longitudinal axis oriented in a third radial direction of the core, and an end portion extending from the base portion and having a longitudinal axis parallel to the longitudinal axis of the first protrusion, the second and third protrusions being arranged on either side of the first protrusion,
- the protrusions include a first row of straight protrusions, a second row of bent protrusions and a third row of bent protrusions, the second row and the third row being arranged on either side of the first row,
- an angle of between 10° and 60°, preferably of between 20° and 25°, is formed between the axis of the base portion and the axis of the end portion of the bent protrusion or protrusions,
- the core has a first end capable of being attached to an applicator rod, and a free second end, and includes an internal cavity and an end aperture which is located at the second end and communicating with the internal cavity,
- the core includes an internal cavity and a wall surrounding the internal cavity, the wall including perforated regions having a series of openings made through the wall and communicating with the internal cavity,
- the openings are diamond shaped and oriented such that a diagonal of a diamond is parallel to the longitudinal axis of the core,
- the wall has solid regions which extend in a longitudinal direction of the core,
- the protrusions have free ends which define an enveloping surface, the enveloping surface having a rounded part and a tapered part.

The invention also relates to an applicator assembly. The assembly includes a receptacle including a body which forms a container containing the cosmetic product, and an applicator, as defined above, capable of being attached to the receptacle, such that the brush is housed within the container.

PRESENTATION OF THE DRAWINGS

Figure 2:
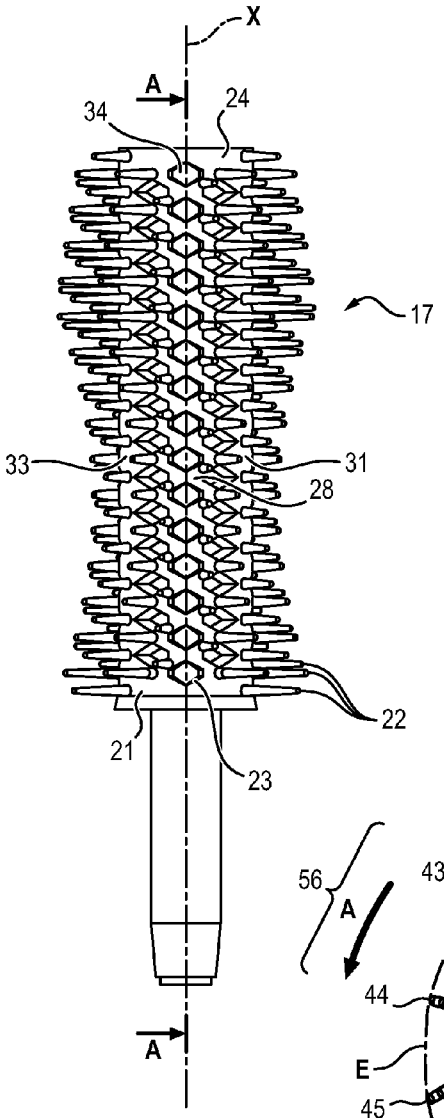
Figure 3A:
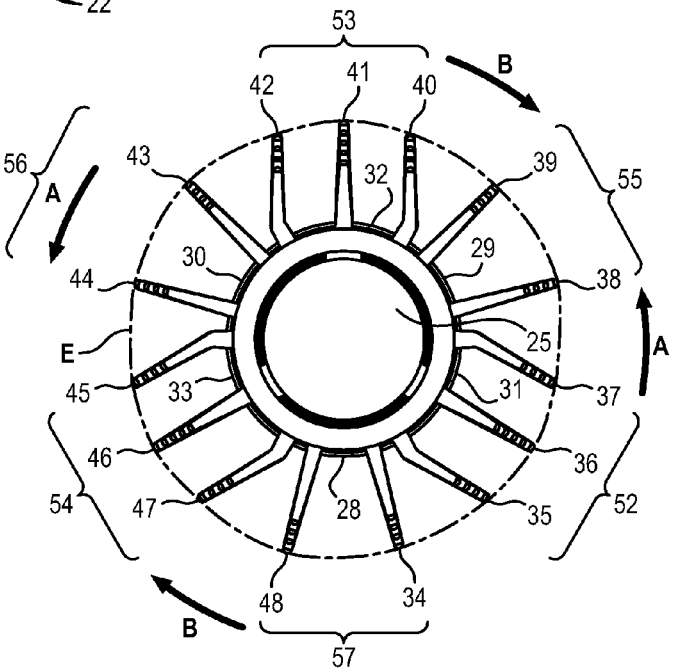
Figure 3B:
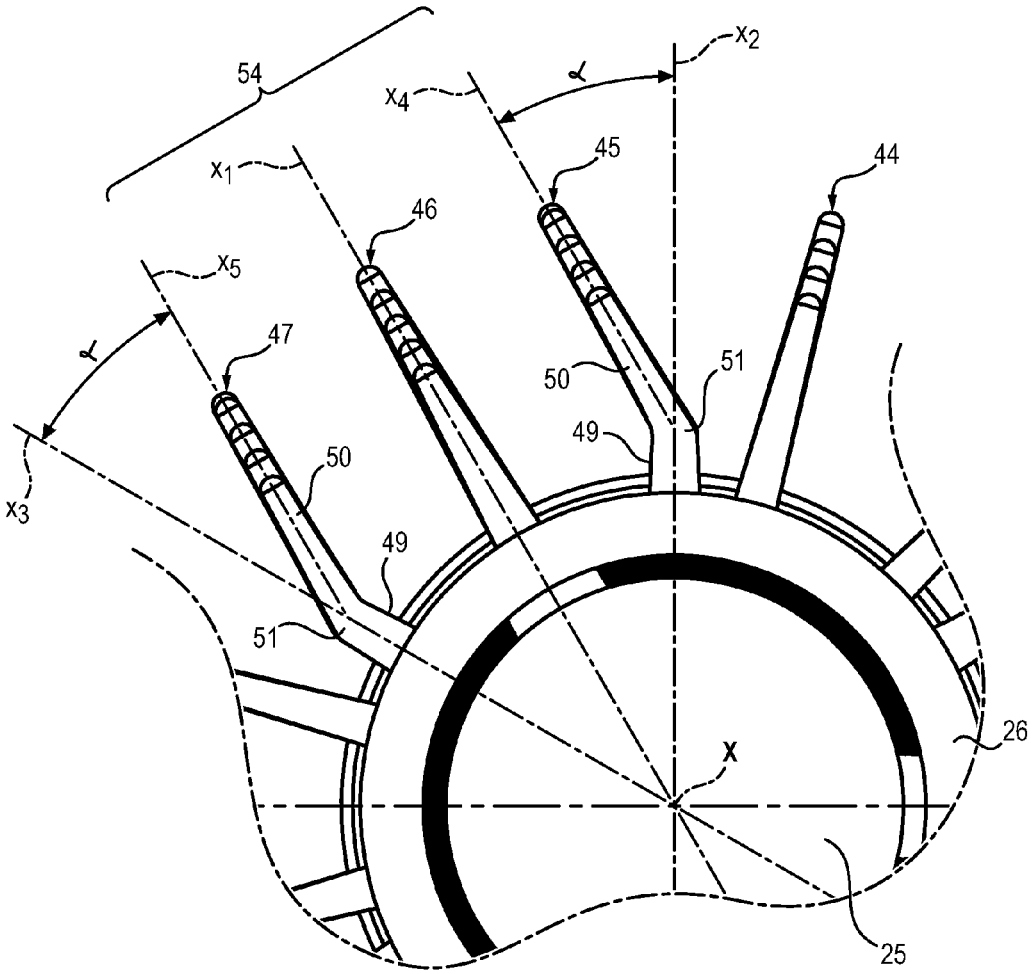
Figure 4:
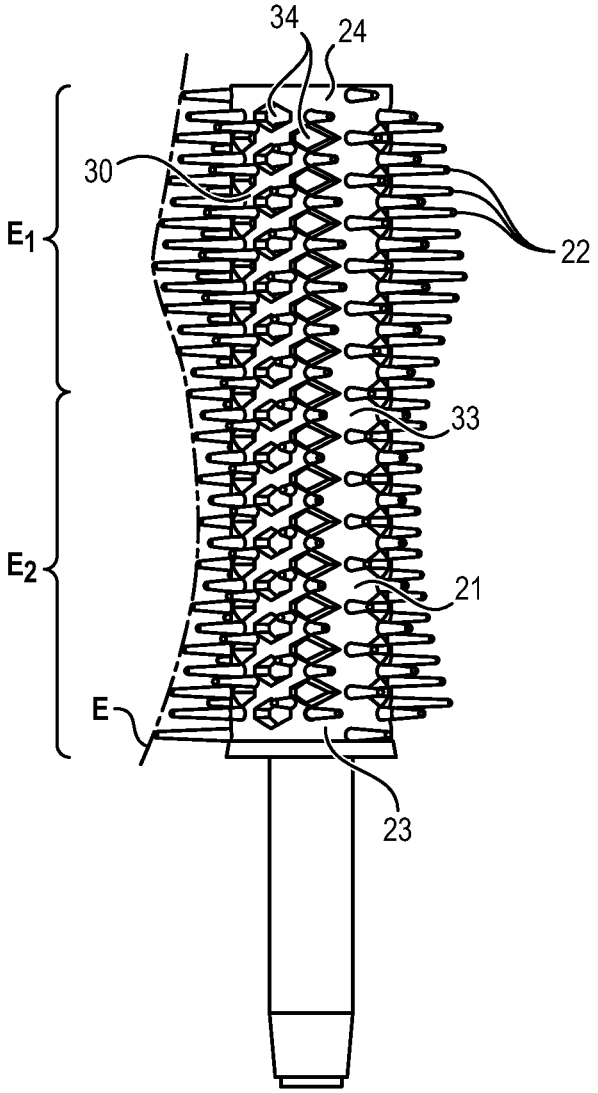
Figure 5A:
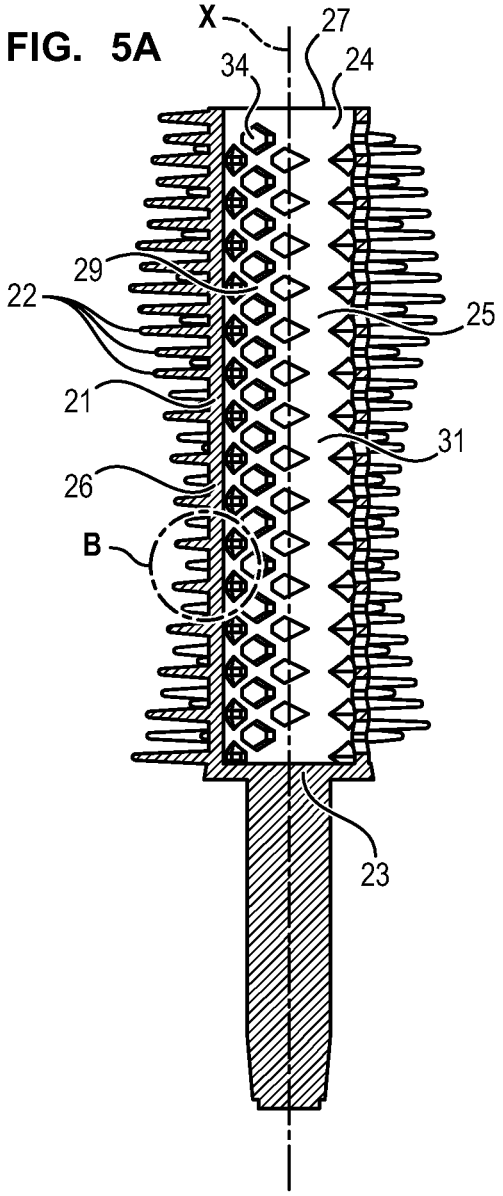
Figure 5B:
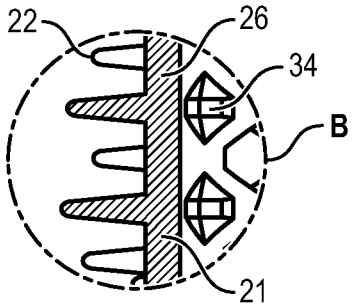

Other features and advantages will become clearer from the following description, which is given merely by way of example, is non-limiting and must be read with reference to the accompanying drawings, in which:

FIG. 1 is a schematic view of an applicator assembly according to an embodiment of the invention, FIG. 2 is a schematic side view of a brush from a first side, FIG. 3A is a schematic top view of a brush, FIG. 3B is a detail view of FIG. 3A, FIG. 4 is a schematic side view of the brush from a second side, FIG. 5A is schematic longitudinal section of the brush along line A-A, and FIG. 5B is a detail view of FIG. 5A.

DETAILED DESCRIPTION OF AN EMBODIMENT

Referring to FIG. 1, the shown applicator assembly 1 comprises a receptacle 2 containing a cosmetic product 3 and an applicator 4 capable of being removably attached to the receptacle 2.

The receptacle 2 comprises a body 5 and a neck 6. The body 5 has a general elongate shape and comprises walls delimiting a container 8 in which the cosmetic product is contained. The neck 6 comprises an external surface 9 having a thread.

The receptacle 2 also comprises a wiper ring 10. The wiper ring 10 is positioned within the neck 6. The wiper ring 10 has a general tubular shape. The wiper ring 10 comprises a cylindrical main portion 11 extending within the neck 6, a shoulder 12 capable of resting on a rim 13 of the neck 6 to secure the wiper ring in the neck and a tapered portion 14 of which the diameter decreases towards the interior of the container 8.

The applicator 4 comprises a handle 15, a rod 16 and a brush 17.

The handle 15 comprises an internal surface 18 having a thread. The thread of the handle 15 is capable of cooperating with the thread of the neck 6 so that the applicator 4 can be attached to the receptacle 2. In this way, the handle 15 acts as a cap to sealingly close the receptacle 2.

The rod 16 has an elongate cylindrical shape and comprises a first end 19 attached to the handle 15 and a second end 20 to which the brush 17 is attached.

The brush 17 is formed in one piece, for example by plastics injection moulding.

The brush 17 is formed in one piece by moulding an appropriate material selected (for example) from: a thermoplastic polyester elastomer such as Hytrel® marketed by DuPont, a thermoplastic polyurethane elastomer such as Pellethane® marketed by Dow, a mixture of thermoplastic materials such as T-BLEND® marketed by TSRC, primarily comprising poly(styrene-butadiene-styrene) (SBS) or poly(styrene-ethylene-butylene-styrene) (SEBS), a low-density polyethylene (LDPE) or an ethylene alpha-olefin copolymer such as Exact® marketed by ExxonMobil.

When the handle 15 is screwed onto the neck 6 of the receptacle 2, the rod 16 and the brush 17 extend within the container 8, the brush 17 being submerged in the cosmetic product.

In use, the user unscrews the handle 15 from the neck 6 and removes the applicator 4 from the receptacle 2. During removal, the applicator 4 slides through the wiper ring 10. Owing to the movement of the applicator 4 through the wiper ring 10, the tapered portion 14 of the wiper ring 10 scrapes the excess cosmetic product from the rod 16 and the brush 17.

As illustrated in FIGS. 2 to 5B, the brush 17 comprises a core 21 having a general shape of a cylinder of revolution which has an axis of revolution X corresponding to a longitudinal direction of the brush 17, and a plurality of elongate protrusions 22 in the form of bristles projecting from the core 21.

The core 21 has a first end 23 capable of being attached to the applicator rod 16, and a free second end 24.

Referring to FIG. 5A, the core 21 is hollow. More specifically, the core 21 comprises a longitudinal channel 25 arranged inside the core 21 and extending in the longitudinal direction X of the core 21 from the first end 23 to the second end 24, and a cylindrical wall 26 surrounding the longitudinal channel 25. The longitudinal channel 25 forms an internal cavity within the core 21. The channel 25 opens into an end aperture 27 at the second end 24.

The cylindrical wall 26 comprises perforated wall portions 28 to 30 and solid wall portions 31 to 33, the solid wall portions 31 to 33 alternating with the perforated wall portions 28 to 30 about the axis X. More specifically, the wall 26 comprises three perforated wall portions 28 to 30 and three solid wall portions 31 to 33. The solid walls 31 to 33 are arranged with an angle of separation of 120° therebetween. Likewise, the perforated walls 28 to 30 are arranged with an angle of separation of 120° therebetween.

Each perforated wall portion 28 to 30 has a series of openings 34 made through the wall 26 and communicating with the internal cavity 25. The solid wall portions 31 to 33 do not have openings.

The openings 34 are diamond shaped and oriented such that a diagonal of a diamond is parallel to the longitudinal axis X of the core 21, in the manner of a grid. The presence of the openings 34 and of the end aperture 27 communicating with the internal cavity 25 promotes a passage of the cosmetic product inside the brush 17.

Each solid wall portion 31 to 33 has an elongate shape and extends parallel to the axis X. The solid wall portions 31 to 33 make it possible to stiffen the core 21, and in particular to compensate for the flexibility of the perforated wall portions 28 to 30.

The protrusions 22 are arranged in a plurality of longitudinal rows 34 to 48, each row extending parallel to the axis X.

More specifically, the brush 17 comprises a plurality of rows of straight protrusions 34, 36, 38, 39, 41, 43, 44, 46 and 48 and a plurality of rows of bent protrusions 35, 37, 40, 42, 45 and 47.

Each row of straight protrusions 34, 36, 38, 39, 41, 43, 44, 46 and 48 comprises a plurality of straight protrusions, each straight protrusion extending in a radial direction of the core. The protrusions in the same row thus extend in parallel and perpendicular to the axis X.

Each longitudinal row of bent protrusions comprises a plurality of bent protrusions 35, 37, 40, 42, 45 and 47.

As illustrated in FIG. 3A, the rows of protrusions are arranged so that two rows of bent protrusions are positioned on either side of a row of straight protrusions.

The brush 17 thus comprises three groups 52, 53 and 54 of rows of protrusions, each group 52, 53 and 54 being made up of two rows of bent protrusions (35, 37; 40, 42; 45, 47 respectively) and one row of straight protrusions (36; 41; 46 respectively) which is positioned between the two rows of bent protrusions. Each row of straight protrusions 36, 41, 46 in a group extends from a respective solid wall portion 31, 32, 33.

The brush 17 also comprises three groups 55, 56 and 57 of rows of protrusions, each group being made up of two rows of adjacent straight protrusions (38, 39; 43, 44; 48, 34 respectively). Each row of straight protrusions in a group 55, 56, 57 extends from a respective perforated wall portion 28, 29, 30.

The groups 52, 53 and 54 alternate with the groups 55, 56 and 57 around the core 21.

FIG. 3B shows, in greater detail, a group 54 made up of a row of straight protrusions 46 and two rows of bent protrusions 45 and 47 which are adjacent to the row of straight protrusions 46.

Referring to FIG. 3B, each straight protrusion 46 has a longitudinal axis $x_1$ oriented in a first radial direction of the core 21.

Each bent protrusion 45, 47 has a straight base portion 49 extending from the core 21 and a straight end portion 50 extending from the base portion 49 in the extension of the base portion 49. The base portion 49 is connected to the end portion by a bend 51.

The base portion 49 of each bent protrusion 45, 47 has an axis $x_2$, $x_3$ oriented in a radial direction of the core 21. The end portion 50 of each bent protrusion 45, 47 has an axis $x_4$, $x_5$ oriented in a direction parallel to the axis $x_1$ of the straight protrusions.

An angle $\alpha$ of between 10° and 60°, preferably of between 20° and 25°, is formed between the axis of the straight base portion 49 and the axis of the straight end portion 50.

The rows of protrusions 35, 36, 37 and 40, 41, 42 are arranged identically to the rows of protrusions 45, 46, 47 shown in FIG. 3B.

Since the bent protrusions 35, 40 and 45 are bent in a first direction, they enable the brush to catch the eyelashes when the user turns said brush about the axis X in a first direction of rotation A. Likewise, since the bent protrusions 37, 42, 47 are bent in a second direction, opposite to the first direction, they enable the brush to catch the eyelashes when the user turns said brush about the axis X in a second direction of rotation B, opposite to the first direction of rotation A.

Finally, referring to FIG. 4, the protrusions 22 have longitudinal dimensions which vary continuously along the axis X of the core 21. In particular, the protrusions 22 have a longitudinal dimension which decrease continuously and then increase from the first end 23 to the second end 24 of the core 21.

The protrusions 22 thus comprise free ends which define an enveloping surface E. The enveloping surface E is symmetrical in revolution about the axis X. The enveloping surface E has a rounded part $E_1$ at the point where the protrusions have maximum dimensions and a tapered part $E_2$ at the point where the protrusions have minimum dimensions.

In use, the brush 17 results in better coating of the eyelashes in the region $E_1$ in which the protrusions are the longest, whereas the brush 17 is loaded with more cosmetic product in the region in which the protrusions are the shortest. Since the protrusions are shorter in the region $E_2$, the protrusions are subjected to a lesser degree of wiping as the brush passes through the wiper ring 10 of the applicator assembly.

The invention claimed is:

1. A cosmetic product applicator comprising a brush, the brush comprising:

a core having a longitudinal axis (X), and a plurality of protrusions projecting from the core, wherein the protrusions comprise at least one straight first protrusion having a longitudinal axis ($x_1$) oriented in a first radial direction of the core, and at least one bent second protrusion, the bent second protrusion comprising a base portion extending from the core and having a longitudinal axis ($x_2$) oriented in a second radial direction of the core, and an end portion extending from the base portion and having a longitudinal axis ($x_4$) parallel to the longitudinal axis ($x_1$) of the straight first protrusion and wherein the core is hollow as a result of a longitudinal channel arranged inside the core and extending in a longitudinal direction of the core.

2. The applicator according to claim 1, wherein the protrusions comprise at least one bent third protrusion comprising a base portion extending from the core and having a longitudinal axis ($x_3$) oriented in a third radial direction of the core, and an end portion extending from the base portion and having a longitudinal axis ($x_5$) parallel to the longitudinal axis ($x_1$) of the straight first protrusion, the second and third protrusions being arranged on either side of the straight first protrusion.

3. The applicator according to claim 1, wherein the protrusions comprise a first row of straight protrusions, a second row of bent protrusions and a third row of bent protrusions, the second row and the third row being arranged on either side of the first row.

4. The applicator according to claim 1, wherein an angle of between 10° and 60° is formed between the axis of the base portion and the axis of the end portion of the bent protrusion or protrusions.

5. The applicator according to claim 1, wherein the core has a first end capable of being attached to an applicator rod, and a free second end, and comprises an internal cavity and an end aperture which is located at the second end and communicating with the internal cavity.

6. The applicator according to claim 1, wherein the core comprises an internal cavity and a wall surrounding the internal cavity, the wall comprising perforated regions having a series of openings made through the wall and communicating with the internal cavity.

7. The applicator according to claim 6, wherein the openings are diamond shaped and oriented such that a diagonal of a diamond is parallel to the longitudinal axis (X) of the core.

8. The applicator according to claim 6, wherein the wall has solid regions which extend in a longitudinal direction of the core.

9. The applicator according to claim 1, wherein the protrusions have free ends which define an enveloping surface (E), the enveloping surface (E) having a rounded part ($E_1$) and a tapered part ($E_2$).

10. An applicator assembly, comprising:

a receptacle comprising a body which forms a container containing a cosmetic product, and an applicator capable of being attached to the receptacle, that applicator comprising a brush housed within the container, the brush comprising:

a core having a longitudinal axis (X), and a plurality of protrusions projecting from the core, wherein the protrusions comprise at least one straight first protrusion having a longitudinal axis ($x_1$) oriented in a first radial direction of the core, and at least one bent second protrusion, the bent second protrusion comprising a base portion extending from the core and having a longitudinal axis ($x_2$) oriented in a second radial direction of the core, and an end portion extending from the base portion and having a longitudinal axis ($x_4$) parallel to the longitudinal axis ($x_1$) of the first straight protrusion and wherein the core is hollow as a result of a longitudinal channel arranged inside the core and extending in a longitudinal direction of the core.

11. The applicator assembly according to claim 10, wherein the protrusions comprise at least one bent third protrusion comprising a base portion extending from the core and having a longitudinal axis ($x_3$) oriented in a third radial direction of the core, and an end portion extending from the base portion and having a longitudinal axis ($x_5$) parallel to the longitudinal axis ($x_1$) of the straight first protrusion, the second and third protrusions being arranged on either side of the straight first protrusion.

12. The applicator assembly according to claim 10, wherein the protrusions comprise a first row of straight protrusions, a second row of bent protrusions and a third row of bent protrusions, the second row and the third row being arranged on either side of the first row.

13. The applicator assembly according to claim 10, wherein an angle of between 10° and 60° is formed between the axis of the base portion and the axis of the end portion of the bent protrusion or protrusions.

14. The applicator assembly according to claim 10, wherein the core has a first end capable of being attached to an applicator rod, and a free second end, and comprises an internal cavity and an end aperture which is located at the second end and communicating with the internal cavity.

15. The applicator assembly according to claim 10, wherein the core comprises an internal cavity and a wall surrounding the internal cavity, the wall comprising perforated regions having a series of openings made through the wall and communicating with the internal cavity.

16. The applicator assembly according to claim 15, wherein the openings are diamond shaped and oriented such that a diagonal of a diamond is parallel to the longitudinal axis (X) of the core.

17. The applicator assembly according to claim 15, wherein the wall has solid regions which extend in a longitudinal direction of the core.

18. The applicator assembly according to claim 10, wherein the protrusions have free ends which define an enveloping surface (E), the enveloping surface (E) having a rounded part ($E_1$) and a tapered part ($E_2$).

* * * * *